United States Patent [19]

Davis

[11] 4,073,216

[45] Feb. 14, 1978

[54] VALVE CONTROL APPARATUS FOR ROTARY ENGINES

[75] Inventor: Gilbert E. Davis, Boise, Idaho

[73] Assignee: Energy Research, Provo, Utah

[21] Appl. No.: 593,003

[22] Filed: July 3, 1975

[51] Int. Cl.[2] ..... F01B 1/06; F02B 57/08

[52] U.S. Cl. ..... 91/480; 123/44 R

[58] Field of Search ..... 123/44 R, 44 E, 44; 91/493, 480

[56] References Cited

U.S. PATENT DOCUMENTS

| | | | |
|---|---|---|---|
| 806,125 | 12/1905 | Farwell | 123/44 |
| 1,060,297 | 4/1913 | Tawgeman | 123/44 |
| 1,227,452 | 5/1917 | Kenyon | 123/44 |
| 1,360,637 | 11/1920 | Hodge | 123/44 |
| 1,381,181 | 6/1921 | Gockerell | 123/44 |
| 1,461,089 | 7/1923 | Hall | 123/44 R |
| 2,683,422 | 7/1954 | Richards | 91/493 |
| 3,521,533 | 7/1970 | Avermaete | 91/496 |
| 3,857,371 | 12/1974 | Gibson | 123/44 R |

FOREIGN PATENT DOCUMENTS

| | | | |
|---|---|---|---|
| 483,149 | 5/1919 | France | 123/44 |
| 128,164 | 6/1919 | United Kingdom | 123/44 |
| 100,097 | 10/1916 | United Kingdom | 123/44 |

*Primary Examiner*—William L. Freeh
*Attorney, Agent, or Firm*—Calvin E. Thorpe

[57] ABSTRACT

Valve control apparatus adapted for use in a rotary engine or pump having a cylinder block rotatable about an axis and including a plurality of cylinders and corresponding pistons radially arranged about the axis, a plurality of valves each disposed in a different one of the cylinders, and a plurality of tappet mechanisms each of which when actuated operates to alternately open and close a different one of the valves. The valve control apparatus includes a cam ring having first and second generally circular cam tracks defined therein for contacting and actuating certain ones of the tappet mechanisms. The cam tracks are disposed in substantially parallel planes and each includes a pair of lobes positioned diametrically opposite in the cam ring. The cam ring is adapted to rotate about the axis in the same direction as the cylinder block but at a speed different therefrom to provide for coaction between the cam tracks and the various tappet mechanisms. With this configuration, the valves for six radially arranged cylinders can be controlled to alternately open and close with each rotation of the cylinder block.

8 Claims, 9 Drawing Figures

VALVE CONTROL APPARATUS FOR ROTARY ENGINES

BACKGROUND OF THE INVENTION

This invention relates to valve control apparatus for use in rotary engines.

For some time there has been an interest in finding practical alternatives to the standard reciprocating internal combustion engines with much of this interest being focused on rotary engine research and development. Various types of rotary engines have been proposed which depart from the conventional cylinder/-piston arrangement, such as the well known Wankel engine, and engines which utilize a cylinder/piston arrangement in an unconventional way, such as the engine disclosed in A. Z. Richards, Jr., U.S. Pat. No. 2,683,422. The latter type engine includes a cylinder unit or block having a plurality of cylinders radially arranged about an axis about which the block rotates. Pistons are disposed to move within the cylinders and also to rotate about a second axis offset from the first mentioned axis.

Because the cylinder block rotates in the Richards type engine, the usual valve actuating cam structure used in standard reciprocating engines is simply not suitable for use in the Richards type engine. Suggestions have been made for eliminating valve arrangements which require mounting valves in the cylinders to move between open and closed positions and to provide instead some type of structure in which openings in the cylinder walls alternately move into alignment first with stationary inlet openings and then with stationary outlet openings to respectively receive fuel charges and then discharge products of combustion. See for example U.S. Pat. No. 3,730,148. However, it is oftentimes difficult with these arrangements to provide an adequate seal for the cylinder openings and this gives rise to a loss of power.

SUMMARY OF THE INVENTION

It is an object of the present invention to provide a simple and compact valve control arrangement for use in rotary engines or pumps having a rotatable cylinder unit and valves disposed in the cylinders.

It is also an object of the present invention to provide a valve control arrangement especially adapted for use with rotary engines or pumps, of the type described, having three or six cylinders.

It is a further object of the present invention to provide valve control apparatus for causing valves disposed in cylinders of a rotating cylinder unit to alternately open or close with each rotation of the unit.

It is still a further object of the present invention, in accordance with one aspect thereof, to provide a cam structure which facilitates the sequential firing of combustion chambers radially arranged in a rotating cylinder unit.

It is another object of the present invention to provide a cam structure in which a single cam track defined in the structure coacts with three tappet mechanisms to control the operation of three valves, each disposed in a different cylinder radially arranged in a rotating cylinder unit.

The above and other objects of the present invention are realized in an illustrative embodiment of valve control apparatus adapted for use in a rotary engine or pump which includes a cylinder unit rotatable about an axis and having at least three cylinders radially arranged about the axis and at least three valves each associated with a different cylinder. At least three tappet mechanisms are carried by the cylinder unit and each is coupled to a different one of the valve mechanisms. The valve control apparatus includes a cam structure, rotatable with respect to the cylinder unit, for defining a generally circular cam track having a pair of lobes disposed diametrically opposite one another. The cam structure is positioned to coact with the tappet mechanisms to thereby cause the tappet mechanisms to alternately open and close corresponding valves as the cam structure and cylinder unit are rotated.

If a six cylinder rotary engine were desired, then an additional cam track of the type already described would be provided. The first mentioned cam track would operate three of the valves and the second mentioned cam track would operate the remaining three valves. This arrangement provides an exceptionally simple, compact and reliable valve control structure for use with rotary engines.

BRIEF DESCRIPTION OF THE DRAWINGS

The objects, features and advantages of the present invention will become apparent from a consideration of the following detailed description presented in connection with the accompanying drawings in which.

DETAILED DESCRIPTION

Figure 1:
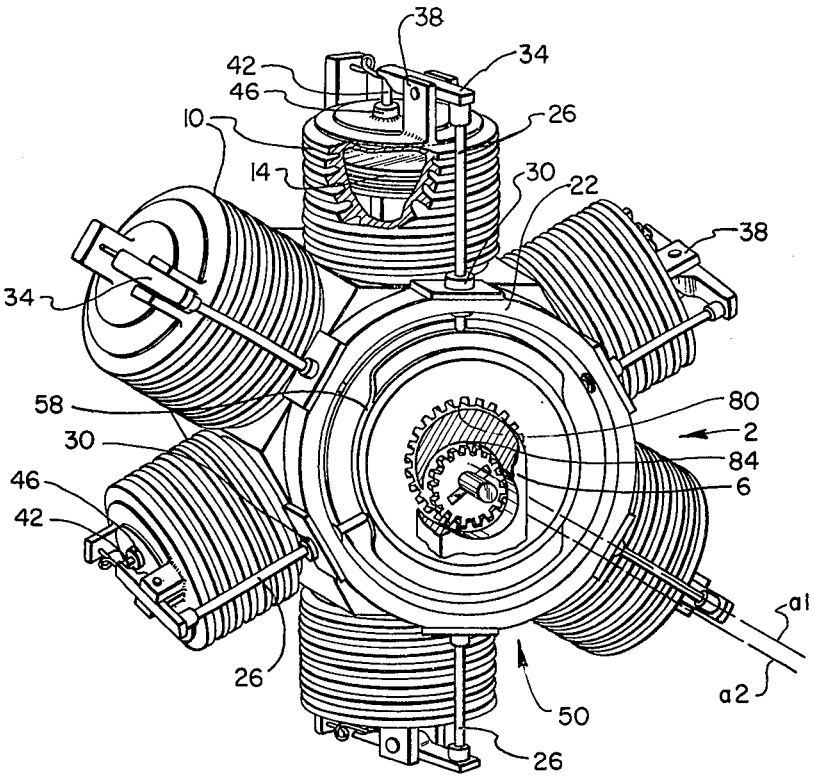
FIG. 1 shows a partially cut-away perspective view of valve control apparatus made in accordance with the principles of the present invention, as such apparatus would be disposed on an exemplary rotary engine.
Figure 2:
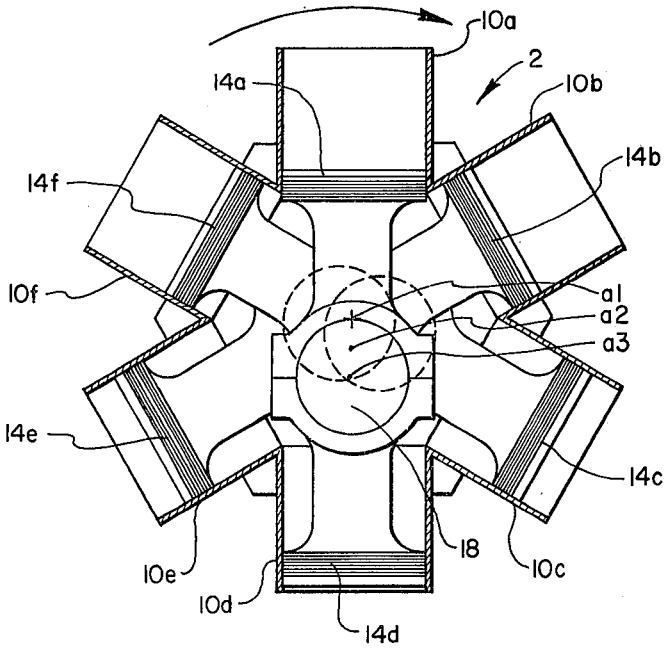
FIG. 2 shows a cross sectional view of the cylinders and pistons of a six cylinder rotary engine of the type on which the valve control apparatus of the present invention could be utilized.

Referring to FIG. 1, there is shown a six cylinder rotary engine of the type generally described in the aforecited A. Z. Richard, Jr. patent. Although a brief description of the structure of such an engine will be here provided, a more complete description of the principles of operation of such an engine can be found in the Richards patent and additional description of a six cylinder version of such an engine can be found in copending patent application, Ser. No. 593,004. The engine of FIG. 1 includes a cylinder unit or block 2 mounted on supporting structure 6 to rotate about an axis $a_1$. The block 2 includes six cylinders 10 radially and uniformly arranged about the axis $a_1$. Pistons 14 are disposed to reciprocate within each cylinder 10 as perhaps best seen in FIG. 2. As shown in FIG. 2, each piston 14 of a cylinder is paired with and coupled to a piston of a diametrically opposite cylinder. Each such pair of pistons is also coupled by rods to a corresponding eccentric 18 which is integral with and mounted on a rotatable shaft whose axis $a_2$ is offset from the axis $a_1$ about which the cylinders rotate. Still referring to FIG. 2 is shown below the axis $a_2$ in the drawing. As the cylinder block 2 is caused to rotate, the piston pair centers, such as center $a_3$, are caused to revolve about stationary axis $a_2$. This operation is fully explained in the aforecited Richards patent.

Referring again to FIG. 1, there is shown a tappet holder 22 mounted on the front of the cylinder block 2 for holding a plurality of tappets 26. The tappet holder 22 includes a plurality of openings spaced thereabout into which are seated individual tappet guides 30. The tappets 26 are disposed in and carried by the tappet guides 30 as shown.

The tappets extend radially outwardly like the spokes of a wheel through the tappet guides 30 and alongside corresponding ones of the cylinder 10. The outermost end of each tappet 26 abuts against one end of a rocker arm 34. Each rocker arm 34 is carried by and pivotally mounted on a pivot support 38 which, in turn, is carried by a corresponding cylinder 10. The other end of each rocker arm 34 is maintained in contact or close proximity with the upper end of a corresponding valve stem of valves 42. The valve stems extend through corresponding valve guides 46 each located on top of a corresponding cylinder 10. Movement of the valves 42 in and out of the respective cylinders 10 operates to open and close the valves in the well known fashion. The tappets, rocker arms and valve structure described are all well known in the engine art and, of course, could have any of a variety of different configurations.

The valve control apparatus of interest here includes the tappets 26 and a cam ring generally indicated by the arrow 50 which is mounted to rotate in the same direction and about the same axis $a_1$ as the cylinder block 2. The cam ring 50, however, is adapted to rotate at either a greater or lesser speed than the cylinder block as will hereafter be described.

Figure 3A:
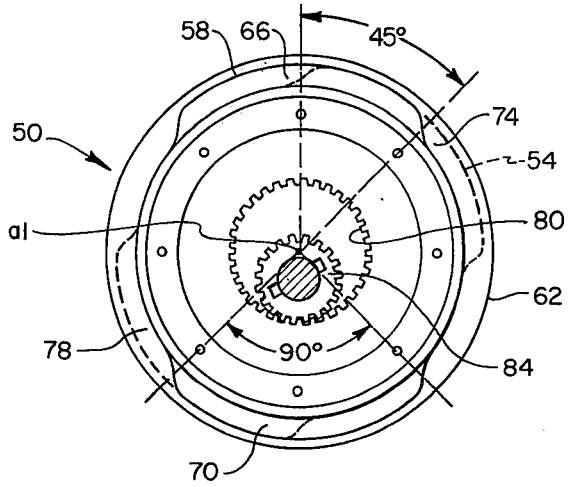
FIGS. 3A and 3B show respectively a front view and a fragmented side view of cam structure of the valve control apparatus of FIG. 1.
Figure 3B:
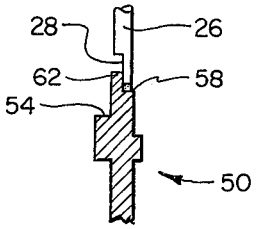

Now refer to FIGS. 3A and 3B where the cam ring 50 is shown in detail. Defined in opposite faces of the ring 50 are generally circular cam tracks 54 (shown by dotted line in FIG. 3A) and 58. An annular flange divider 62 is disposed between and separates the two cam tracks 54 and 58; the tracks 54 and 58 and divider 62 define three generally parallel planes with the rim of the divider 62 extending radially outwardly beyond both tracks. Both tracks 54 and 58 are contoured to include a pair of lobes, such as lobes 66 and 70 of track 58 shown in FIG. 3A, positioned diametrically opposite in the cam ring 50. As indicated in FIG. 3A for track 58, the lobes extend circumferentially through an angle of about 90 degrees. Of course, since each lobe of a track extends through an angle of about 90 degrees, the gaps between the lobes similarly extend through an angle of about 90°. As is clear from FIG. 3A, the curved surfaces of the lobes of each cam track 54 and 58 are disposed at a first radius from the center of the cam ring 50, whereas the curved surfaces of the gaps between the lobes are disposed at a second radius which is less than the first.

In the cam ring embodiment shown in FIGS. 3A and 3B, the lobes of the cam track 54 are circumferentially spaced by about 45° from the lobes of cam track 58. This is best seen in FIG. 3A where the lobes of track 54, indicated by numerals 74 and 78, are shown in dotted line, rotated clockwise from lobes 66 and 70 of track 58 through an angle of 45°. The reason for this will be explained later.

As previously indicated, the cam ring 50 is mounted to rotate about axis $a_1$ in the same direction as the cylinder block 2 is rotated. This is facilitated by providing internal gear teeth 80 in an opening in the center of the cam ring 50. The gear teeth 80 mesh with and are driven by a gear wheel 84 which is coupled to the crankshaft of the engine, i.e., to the shaft on which the eccentrics 18 shown in FIG. 2 are mounted. Rotation of the cylinder block 2 causes the eccentrics and thus the crankshaft to rotate. The gearing 80 and 84 is adapted to cause the cam ring 50 to rotate at three-quarters the angular speed of the rotation of the cylinder block 2. Since the cam ring 50 turns at a speed different from that of the cylinder block 2, the cam tracks 54 and 58 move relative to the tappets 26 to thereby raise and lower the tappets and actuate the rocker arms 34 and the valves 42. The reason for providing rotation of the cam ring 50 at three-quarters the speed of rotation of the cylinder block 2 will be explained momentarily. The effect is that the cam ring 50 is retarded by one fourth of a turn relative to the cylinder block 2 with each rotation of the cylinder block. The gearing 80 and 84 could be adapted to cause the cam ring 50 to advance one-fourth of a turn relative to the cylinder block 2 with each rotation of the cylinder block and the same valve control result would be achieved. In such case, the cam ring 50 would be rotated one and one-fourth turns for every rotation of the cylinder block 2.

As shown in FIG. 1, the cam track 58 on one face of the cam ring 50 coacts with every other one of the tappets 26 spaced about the cam ring 50. The remaining tappets coact with the cam track 54 (not shown in FIG. 1). In explaining the valve control operation, reference will be had to FIGS. 4A through 4E where only one of the cam tracks is shown coacting with three of the tappets. It will be understood that the other cam track coacts in the same manner with the other tappets to effect the valve control operation which will now be described.

The ends of the tappets 26 adjacent the cam ring 50 are each formed with a flat face 28 (FIG. 3B) disposed in close proximity to the side of the divider 62. With such an arrangement, the tappets are prevented from rotating thus providing a more stable operation and the tappets serve as guides to maintain the cam ring so in position.

Referring now to FIG. 2, there is shown the position of the six pistons 14 disposed in the six cylinders 10 for a particular orientation of the cylinder block 2. As the cylinder block 2 is rotated in the clockwise direction, the piston 14*a* begins to move outwardly in the cylinder 10*a* so that when the cylinder 10*a* reaches the position shown for cylinder 10*b* in FIG. 2, the piston 14*a* will have moved to the position in which piston 14*b* is shown as occupying in FIG. 2. Similarly, piston 14*f* will continue an inward movement in cylinder 10*f* so that when cylinder 10*f* reaches the position occupied by cylinder 10*a* in FIG. 2, the piston 14*f* will be in the position now occupied by piston 14*a*. In other words, as the cylinder block 2 is rotated, the pistons 14 move from an inwardmost position of their stroke when the corresponding cylinder is at top center (the position occupied by cylinder 10*a* in FIG. 2), through a position in which the piston is at its outermost position of the stroke when the corresponding cylinder is at bottom center (the position occupied by cylinder 10*d* in FIG. 2), back to the position where the piston is again at its inwardmost position of the stroke when the corresponding cylinder is again at top center. The movement of the pistons as the cylinder block 2 is rotated is fully described in the aforecited Richards patent.

Figure 4A:
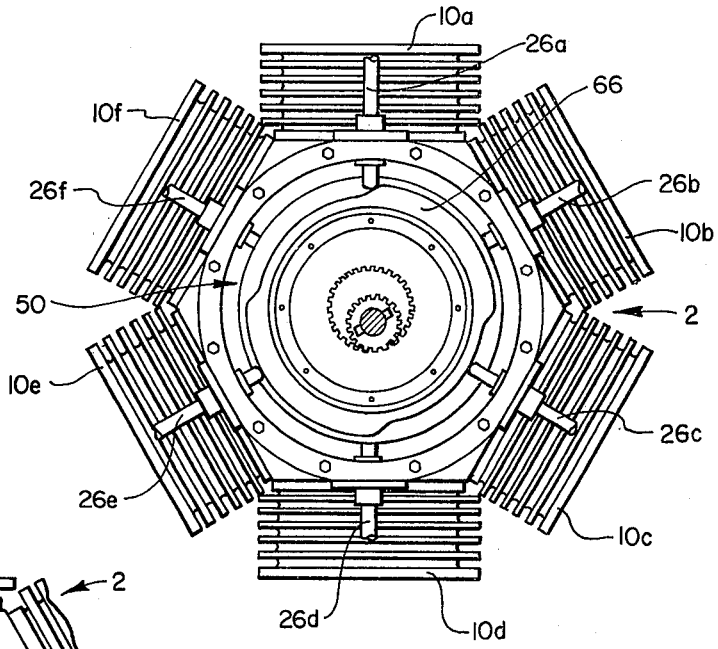
FIGS. 4A through 4E are diagramatic views of a six cylinder rotary engine showing different stages of rotation of the engine and cam structure of the present invention.

FIGS. 4A through 4E show successive positions of the cam track 58 as the cylinder block 2 is rotated through two revolutions. The valve control operation will be described by referring specifically to cylinder 10*a* and its associated tappet 26*a*. In FIG. 4A, the cylinder 10*a* is shown at top center at which position, one lobe 66 of the cam track 58 is just beginning to move under the tappet 26*a* to raise the tappet and thereby open the corresponding valve. Remember that since the cam ring 50 is rotating at an angular speed less than that of the cylinder block 2, and in this case in the clockwise direction, the cam ring 50 is in effect rotating in the counterclockwise direction relative to the cylinder block 2. Thus in FIG. 4A, the lobe 66 of the cam track 58 is just beginning to move counterclockwise relative to the cylinder block 2 and under the tappet 26*a* to raise the tappet and open the valve.

Figure 4B:
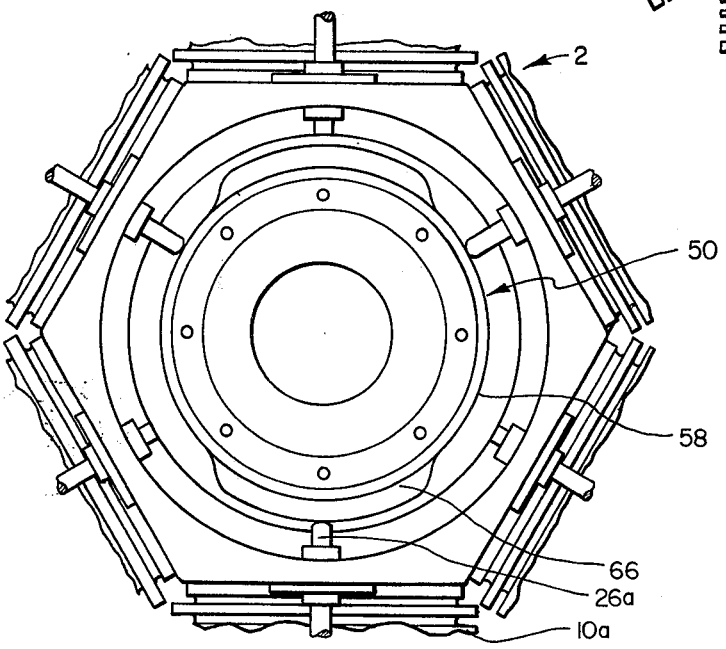

FIG. 4B shows the cylinder block of FIG. 4A with the block rotated through 180° so that the cylinder 10*a* is now at bottom center. In this position, the lobe 66 of the cam track 58 is now centered under the tappet 26*a* so that the corresponding valve is still in the open position. Note that the cam ring 50 has rotated through an angle of 135° while the cylinder block 2 has rotated through an angle of 180°.

Figure 4C:
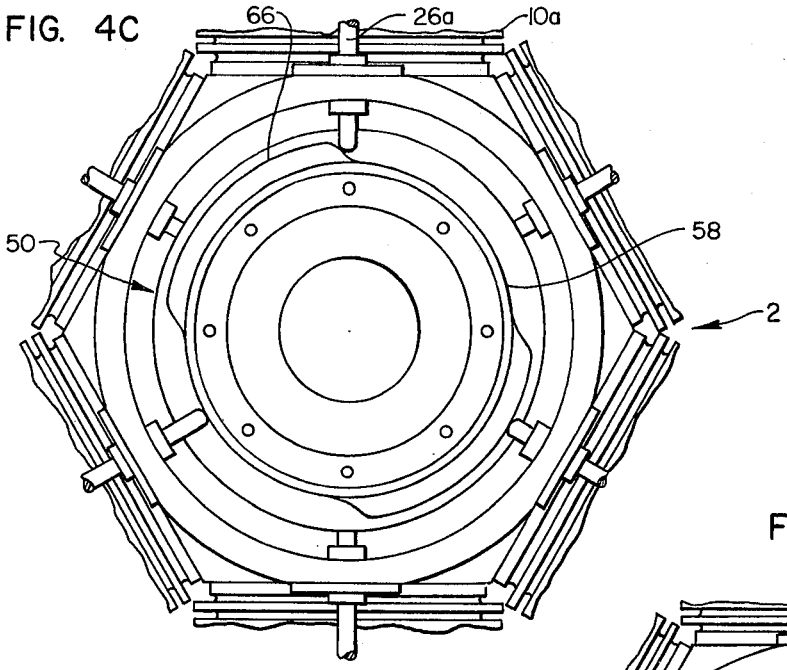
Figure 4D:
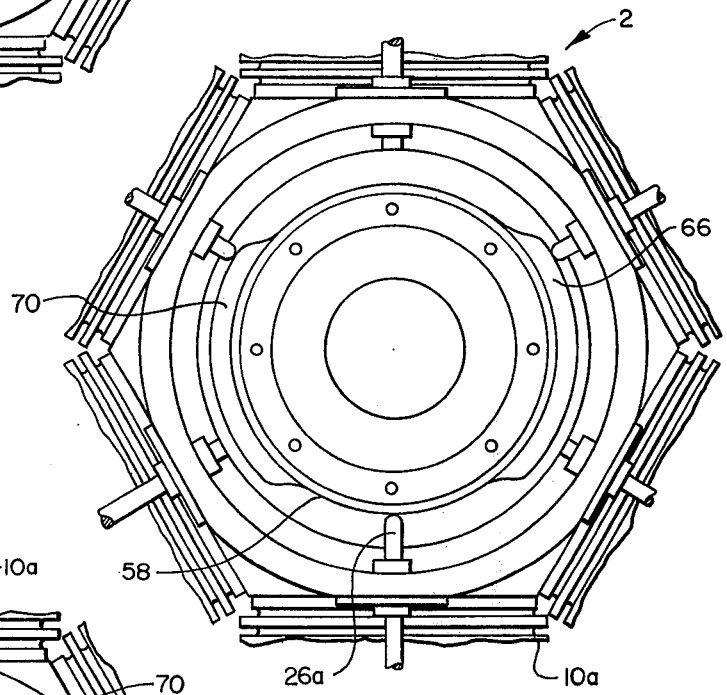
Figure 4E:
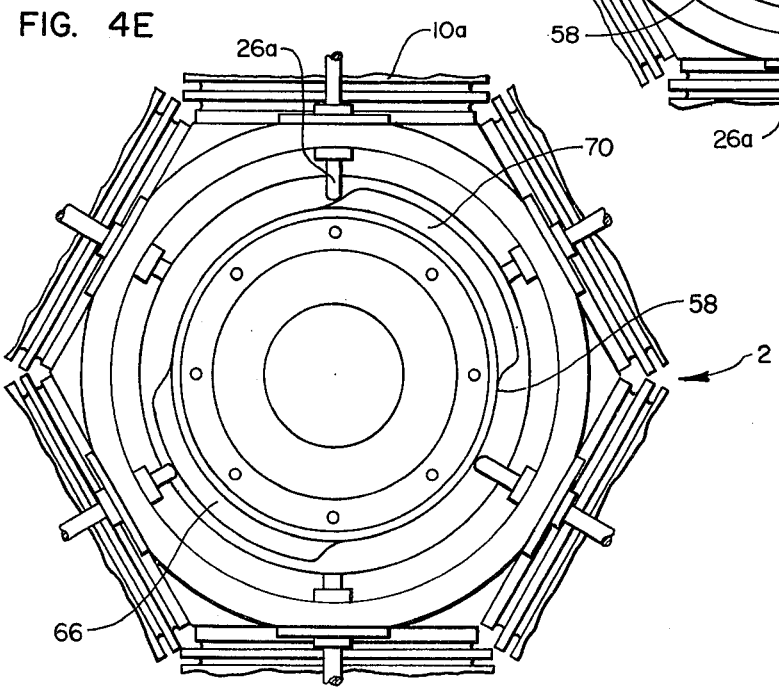

FIG. 4C shows the cylinder block 2 after a further rotation of 180° so that the cylinder 10*a* is at top center again. The cam ring 50 has rotated through an angle of 135° and in this position the lobe 66 is just moving out from under the tappet 26*a* so that the tappet moved inwardly closing the corresponding valve. In FIG. 4D, the cylinder block 2 has rotated through another 180° angle so that the cylinder 10*a* is now at bottom center and the tappet 26*a* is centered in the gap between lobe 66 and lobe 70 of the cam track 58. The valve corresponding to the tappet 26*a* at this time is closed. When the cylinder block 2 rotates through another 180° angle, as shown in FIG. 4E, the cylinder 10*a* is again at top center with the lobe 70 of the cam track 58 just beginning to move under the tappet 26*a* and begin the previously described sequence over again. In the manner described, the valve which is actuated by the tappet 26*a* is caused to alternately open and close with each full revolution of the cylinder block 2. The cam track 58 similarly causes the valves actuated by tappets 26*c* and 26*e* (FIG. 4A) to alternately open and close corresponding valves with each revolution of the cylinder block 2. The valves positioned in cylinders 10*b*, 10*d* and 10*f* are similarly actuated by tappets which coact with cam track 54 (not shown in FIGS. 4A through 4E).

Briefly, regarding the firing of cylinder 10*a* shown in FIGS. 4A through 4E, while the valve of cylinder 10*a* is open (FIGS. 4A and 4B), exhaust gases from a previous combustion are forced out of the cylinder and then, while the cylinder block 2 rotates from the position of FIG. 4B to the position of FIG. 4C, an inlet fuel charge is applied to the cylinder. In FIGS. 4C and 4D, when the valve of cylinder 10*a* is closed, the fuel charge is compressed and then just as cylinder 10*a* reaches the bottom center position of FIG. 4D, ignition takes place and the fuel charge expands as the cylinder block 2 rotates from the position of FIG. 4D to the position of FIG. 4E. In FIG. 4E, the valve of cylinder 10*a* begins to open to allow the exhaust products to be discharged from the cylinder and the previously described sequence is repeated.

By circumferentially spacing the lobes of the two cam tracks 54 and 58 (FIG. 3) by 45°, the cylinders can be adapted to fire always at the same angular position and in a semi-sequential order. That is, a firing order may be provided in which two adjacent cylinders are fired sequentially, the next two adjacent cylinders are not fired, and then the following two adjacent cylinders are fired sequentially, etc. This firing order can give significant operating advantages.

Providing the cam control apparatus described above allows the use of only two tracks to control the valve operation for a six cylinder rotary engine. Since only two tracks are needed, the engine can be made more compact and simple. Although the present invention has been described for a six cylinder rotary engine, it is clear that if a three cylinder rotary engine were contemplated, then only a single cam track of the type described would be needed. Of course, engines having multiples of three cylinders would require a cam track for each group of three cylinders.

It is to be understood that the above-described arrangement is only illustrative of the application of the principles of the present invention. Numerous other modifications and alternative arrangements may be devised by those skilled in the art without departing from the spirit and scope of the present invention and the appended claims are intended to cover such modifications and arrangements.

What is claimed is:

1. Valve actuating apparatus for use in a rotary engine or pump which includes a cylinder unit rotatable about an axis and having at least three cylinders radially arranged about the axis and at least three valve means, each associated with a different cylinder, said apparatus comprising means defining a generally circular cam track having a pair of lobes disposed substantially diametrically opposite one another, each of said lobes extending circumferentially through an angle of substantially 90°, said cam track means including an annular flange disposed at one side of said cam track and extending radially outwardly therebeyond, means for causing said cam track means to rotate relative to said cylinder unit, and at least three tappet means carried by said cylinder unit and each coupled to a different valve means for coacting with said cam track to operate the corresponding valve means alternately to open and closed positions with each rotation of the cylinder unit and as the cam track is rotated, each tappet means including a generally elongate member one end of which has a generally flat side face disposed in close proximity with one side of said flange, said tappet means thereby being prevented from rotating.

2. Apparatus as in claim 1 wherein said cam track means is adapted to rotate at three-fourths the speed of rotation of said cylinder unit.

3. Apparatus as in claim 1 wherein said cam track means is adapted to rotate at one and one-fourth the speed of rotation of said cylinder unit.

4. In a rotary engine or pump having a cylinder block rotatable about an axis and including at least six cylinders circumferentially spaced about the axis, and at least six valves each disposed in a different one of said cylinders, valve control apparatus comprising at least six tappet means carried by the cylinder block, each of which when actuated alternately opens and closes a different one of the valves, a cam ring having a first generally circular cam track defined therein for contacting and actuating at least three of the tappet means, and a second generally circular cam track defined in the cam ring in a plane generally parallel with the plane of the first cam track for contacting and actuating at least three of the other tappet means not actuated by the first cam track, said first and second cam tracks each including a pair of lobes positioned diametrically opposite in the ring, said lobes extending circumferentially about the cam ring through an angle of substantially 90°, the gaps between the corresponding pairs of lobes thereby also extending circumferentially about the cam ring through an angle of substantially 90°, said lobes of the first cam track being circumferentially displaced from the lobes of the second cam track by an angle of substantially 45°, and wherein the first cam track is disposed to actuate tappet means which operate the valves of every other cylinder, and wherein the second cam track is disposed to actuate the tappet means which operate the remaining valves, and means for rotating the cam track about said axis in the same direction in which the cylinder block is rotated at a speed different from the speed of rotation of the cylinder block to cause the cam tracks to actuate said tappet means.

5. Valve control apparatus as in claim 4 wherein said cam ring further includes a flange divider extending circumferentially about the cam ring and separating the first and second can tracks, and wherein each of said tappet means includes an elongate shank extending radially outwardly of said cam ring, a side of one end of each shank being formed into a generally flat surface close to a side of said flange divider such that said divider prevents the tappet means from rotating.

6. Valve control apparatus as in claim 4 wherein said cam ring rotating means is adapted to rotate the cam ring at a speed to cause each valve to alternately open or close with each revolution of the cylinder in which said each valve is disposed.

7. Valve control apparatus as in claim 6 wherein said cam ring rotating means is adapted to rotate the cam ring at substantially three-fourths the speed of rotation of the cylinder block.

8. Valve control apparatus as in claim 6 wherein said cam ring rotating means is adapted to rotate the cam ring at substantially one and one-fourth the speed of rotation of the cylinder block.

* * * * *